US005690502A

United States Patent [19]

Mochizuki

[11] Patent Number: 5,690,502

[45] Date of Patent: Nov. 25, 1997

[54] EDGE CONNECTOR

[75] Inventor: Shoichi Mochizuki, Tokyo, Japan

[73] Assignee: Kel Corporation, Tokyo, Japan

[21] Appl. No.: 611,204

[22] Filed: Mar. 5, 1996

[30] Foreign Application Priority Data

Mar. 10, 1996 [JP] Japan ..... 7-079610

[51] Int. Cl.[6] ..... H01R 13/62

[52] U.S. Cl. ..... 439/328

[58] Field of Search ..... 439/325, 326, 439/327, 328, 157, 159

[56] References Cited

U.S. PATENT DOCUMENTS 5,267,872 12/1993 Gou et al. ..... 439/328 X
5,389,000 2/1995 Diviesti et al. ..... 439/328 X

FOREIGN PATENT DOCUMENTS 3108286 5/1991 Japan .

OTHER PUBLICATIONS

Abstract JP 3-108286 (above).

*Primary Examiner*—Khiem Nguyen
*Attorney, Agent, or Firm*—Robert W. J. Ushe

[57] ABSTRACT

An edge connector 1 comprises mechanism 5 having an engaging lock 54 and a releasing lever 25, in each arm 22 of the housing 2. The engaging lock 54 is formed of a metal and incorporated in the housing 2 and capable of shifting between an engaging position and a releasing position. The engaging position is where a circuit board installed in the edge connector 1 is engaged and retained by the engaging lock 54. The releasing position is where the circuit board is released from the engagement. The releasing lever 25 is formed of resin in one piece with the housing 2 and capable of engaging with the engaging lock 54. When the releasing lever 25 is manually operated to shift outward, the engaging lock 54 is shifted from the engaging position to the releasing position.

12 Claims, 9 Drawing Sheets

EDGE CONNECTOR

FIELD OF THE INVENTION

The present invention relates to an edge connector for installing a circuit board, which has a plurality of electrically conductive pads on one edge, such as a memory module, onto another circuit board.

BACKGROUND OF THE INVENTION

An edge connector for installing a modular circuit board such as a memory module to a mother board is shown in FIGS. 10A, 10B and 10C. The main body of this edge connector 81 is formed of an insulative material such as plastic resins. As shown in FIG. 10A, a modular circuit board 86 is inserted into a receptive space formed in the front portion of the edge connector 81, with the rear portion of the modular circuit board 86 raised above the arms 82 of the edge connector 81. Then, this modular circuit board 86, whose front portion is received in the receptive space and whose rear portion is raised (hereinafter, this state is referred to as "the jumped-up position"), is pushed and lowered into a position where the modular circuit board 86 is placed parallel with the arms 82 and the mother board (hereinafter referred to as "the installation position"), so that it is mounted in the edge connector 81.

On the arms 82 of this edge connector 81, latches 85 are provided in order to fixedly retain the circuit board 86 mounted in the installation position. These latches 85 extrude inward from the arm 82 and engage with the upper surface of the circuit board 86 placed in the installation position. When these latches 85 are opened laterally outward with respect to the arms 82, the circuit board 86 is allowed to shift between the jumped-up position and the installation position. In order to smoothly carry out the engagement and disengagement of the latches 85, cutout portions 86*a* are provided at the sides of the circuit board 86.

Each of these latches 85 has an engaging portion 85*a* and a tab 85*b*. The engaging portions 85*a* are capable of engaging and disengaging with the cutout portions 86*a*. The tabs 85*b* are pushed outward to position the latches 85 laterally outward with respect to the arms 82 when the circuit board 86 is being mounted or removed.

When the circuit board 86 in the edge connector 81 is being replaced, these tabs 85*b* are pushed laterally outward, so that the engaging portions 85*a* are released from the cutout portions 86*a* of the circuit board 86. Then, the circuit board 86 raises into the jumped-up position.

Such an edge connector is, for example, disclosed in Japanese Laid-open Patent. Application No. H3 (1991)-108286. In this edge connector, latches 85 are formed of an elastic metal, separate from the arms 82 in order to improve the durability of the latches 85, which repeatedly engage and disengage with a circuit board 86 installed. Then, these latches 85 are incorporated in the arms 82 in such a way that the latches 85 swing laterally with respect to the arms 82.

In the edge connector 81, it is important to position the circuit board 86 which is to be mounted, correctly in the installation position. For the purpose of positioning the circuit board 86 correctly, cutout portions 86*a* are provided to the circuit board 86, and a positioning boss, which fits into one of the cutout portions 86*a*, is provided in the lower portion of each engaging portion 85*a*.

However, this construction of the edge connector sometimes presents a problem of incorrect positioning of the circuit board. Since the latches are formed separate from the arms, it is difficult to position the latches accurately with respect to the arms in assembling the edge connector. If the latches are not positioned correctly, then the positioning of the circuit board in the edge connector is not reliable because it depends on the positioning bosses, which are formed in one piece with these latches.

If the positioning bosses are positioned incorrectly in the edge connector, then the circuit board will be engaged and retained improperly by the engaging portions of the edge connector. In this improper engagement, the circuit board may get ousted by a little vibration, or the electrical pads of the circuit board may not contact effectively with the contacts of the edge connector.

If the circuit board is inserted into the edge connector insufficiently, the circuit board will be also engaged improperly by the engaging portions because the positioning bosses do not fit into the cutout portions. In such a condition, the circuit board may get ejected or may experience improper electrical connection of the electrical pads and the contacts, in the same way as mentioned above.

Furthermore, the edge connector of this construction presents still another problem that the tabs or disengaging portions, which are touched with fingers, feel rough because they are made of a metal plate.

SUMMARY OF THE INVENTION

The present invention is conceived to solve such problems as mentioned above. It is an object of this invention to provide an edge connector which ensures the correct positioning of a circuit board mounted therein. Another object of this invention is to provide an edge connector which ensures the engagement and retention of a circuit board mounted therein. Yet another object of this invention is to provide an edge connector which feels smooth when it is touched for disengaging a circuit board mounted therein.

These objectives of the present invention are realized by an edge connector having a receptive space and a pair of arms. This receptive space has a plurality of contacts and receives the front portion of a circuit board inserted thereinto. The arms are provided with locking means, which fixedly retains the circuit board positioned along the arms. After the insertion of the front portion of the circuit board into the receptive space, the circuit board is pushed and lowered from a jumped-up position, where the rear portion of the circuit board is positioned above the arms, into an installation position, where the circuit board is positioned and retained along the arms. With this lowering of the circuit board into the installation position, the circuit board is engaged with the locking means and retained in the edge connector.

The locking means, which engages with the circuit board and retains it, has a pair of engaging locks and a pair of releasing levers. Each engaging lock is formed of metal and mounted in each arm of the housing of the edge connector and capable of being moved between an engaging position and a releasing position. In the engaging position, the engaging locks incorporated in both arms engage with the circuit board mounted in the installation position and retain it therein, and in the releasing position, the engaging locks release the circuit board therefrom. Each releasing lever is formed of resin in one piece with the housing and is capable of engaging with the respective engaging lock. The releasing levers are operated for a releasing operation, in which the engaging locks are moved from the engaging position into the releasing position.

It is preferable that the engaging locks laterally swing when being moved between the engaging position and the releasing position.

When a circuit board is installed into or removed out of the edge connector, the engaging locks, which are made of metal, are moved between the engaging position and the releasing position. As the engaging locks are designed capable of engaging with the releasing levers, the user only needs to operate the releasing levers, which are made of resin, for shifting the engaging locks to the releasing position. Because the user does not touch the metal parts, i.e., the engaging locks, the edge connector feels smooth to operate.

The edge connector of the present invention further comprises a pair of positioning bosses, which may be formed in one piece with the releasing levers. These positioning bosses fit into positioning concavities, which are provided on the sides of a circuit board to be installed. When the circuit board is being engaged, the fitting of the positioning bosses into the positioning concavities ensures the correct positioning of the circuit board in the edge connector. If these positioning bosses are formed in one piece with the housing of the edge connector, then the location of their relative positions in the edge connector is ensured with high precision in molding production. Therefore, correct positioning is ensured in setting the circuit board in the installation position of the edge connector.

When the releasing levers are operated for the releasing operation, the releasing levers engage with the engaging locks and shift them into the releasing position. However, when the engaging locks are moved from the engaging position to the releasing position, it is not necessary for the releasing levers to be also moved into the releasing position. The releasing levers may be constructed not to move along with the engaging looks. If the edge connector is constructed as such, when the circuit board is pushed and lowered from the jumped-up position into the installation position, only the engaging locks, which are always standing by at the engaging position, once shift into the releasing position to accept the circuit board and then return to the engaging position to engage with the circuit board received therein and retain it. On the other hand, when the releasing levers are operated outward, the releasing levers shift the engaging locks together with themselves into the releasing position in the same way as described previously. As a result, the circuit board is removed out of the edge connector.

This edge connector having the releasing levers constructed in this way may be also provided with positioning bosses which are formed in one piece with the releasing levers. With these positioning bosses, incorrect positioning of the circuit board is avoided. If the insertion of the circuit board into the receptive space is incomplete or insufficient, then when the circuit board is pushed and lowered into the installation position, the positioning bosses hit the circuit board being lowered because they do not fit into the positioning concavities of the circuit board. The reason is that even though the engaging locks are moved into the releasing position, the releasing levers are not moved along with the engaging locks, thus hitting the circuit board.

In this way, the circuit board is not allowed to be completely lowered into the installation position if it is inserted insufficiently. Thus, incorrect positioning of the circuit board is easily detected. With this edge connector, the circuit board is not allowed to be installed or retained in incorrect position.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only and thus are not limitative of the present invention and wherein.

DESCRIPTION OF THE PREFERRED EMBODIMENTS

Figure 1:
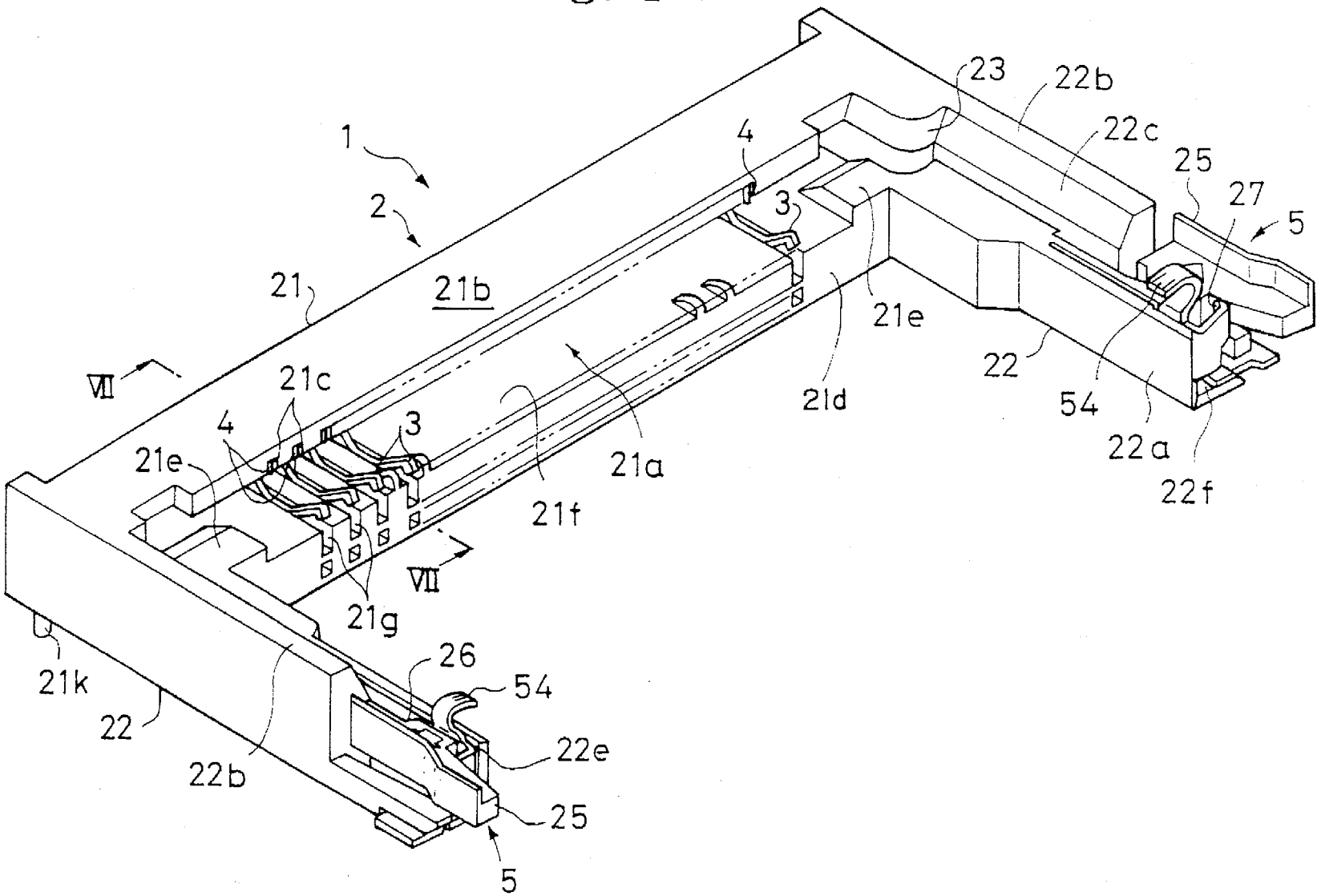
FIG. 1 is a perspective view of an edge connector of the present invention.

FIG. 1 shows an edge connector of the present invention. This edge connector 1 comprises a housing 2, a plurality of contacts, and a locking mechanism 5. This housing 2 is formed in one body of an insulative material such as plastics (resin), and the contacts, which include lower contacts 3 and upper contacts 4, are retained in the housing 2. The locking mechanism 5 is provided in the left portion and right portion of the housing 2.

The housing 2 comprises a main body 21, which extends laterally, and arms 22, which extends backward from the lateral ends of this main body 21 (note: in FIG. 1, "back or rear" of the edge connector is the side closer to the viewer of the drawing). Inside the main body 21, a module-receiving slot 21 a (described as receptive space in other sections of the specification) is formed extending laterally and opening in the back-and-forth direction. A plurality of upper contact-receiving grooves 21*c* are formed back and forth in lateral multiplication, parallel with one another, in the lower side of the upper wall 21*b* facing the module-receiving slot 21*a* from above.

On the upper surface of the lower wall 21*d* facing the module-receiving slot 21*a* from below, board-setting surfaces 21*e* are provided each formed closer to the lateral ends and to the rear of the main body. Between these board-setting surfaces 21*e*, a contact-aligning plane 21*f* is formed with a height lower than the board-setting surfaces 21*e*. The front portion of each board-setting surface 21*e* is tapered forward, so that its surface gradually levels into the contact-aligning plane 21*f*.

A plurality of lower contact-receiving grooves 21*g* are formed back and forth in lateral multiplication, parallel with one another, in the contact-aligning plane 21*f* in such a way that the upper contact-receiving grooves 21*c* and the lower contact-receiving grooves 21*g* are aligned in a vertically staggered fashion.

On the lower surface of the lateral front end of the housing 2, bosses 21*k* are provided downward, so that the edge connector 1 is easily positioned on a mother board (not shown in the drawings) such as used for computers.

Each arm 22 comprises an inside portion 22*a*, which faces the inside of the edge connector 1, and an outside portion 22*b*, which faces the outside of the edge connector 1. The upper surface of the inside portion 22*a* is as high as the board-setting surface 21*e*, and the upper surface of the outside portion 22*b* is higher than that of the inside portion 22*a*. The inside surface 22*c* of the outside portion 22*b* is formed with a slant opening upward, so that a modular circuit board, which will be described later, is set easily onto the board-setting surfaces 21*e*.

A male key 23 is formed at the border between the main body 21 and the right arm 22 in such a way that the male key 23 protrudes in an approximate "L" figure over the board-setting surface 21*e* and the inside portion 22*a*, and the above mentioned slant extends from the inside surface 22*c* over to the peripheral surface of the male key 23.

As shown in FIG. 7, each lower contact 3 comprises a base portion 31, an inserted portion 33, and a contacting portion 34. The base portion 31 extends vertically, and the inserted portion 33 extends rearward (rightward in the drawing) from the lower-rear part of base portion 31. The contacting portion 34 extends upward a little from the upper-rear part of the base portion 31 and then rearward, extending further with a downward-and-upward curve in a flattened "U" figure, and and ends in a downwardly slanted end portion 34*a*.

These lower contacts 3 are stamped into the housing 2 from the front thereof and are retained therein. The "U" portion of each contact 34 is received in its respective, lower contact-receiving groove 21*g*, and its end portion 34*a* protrude from the rear part of the contact-aligning plane 21*f* into the module-receiving slot 21*a*.

Each upper contact 4 comprises a base portion, a lead portion and an inserted portion, all of which are formed in the same configuration as those of the lower contact 3, and a contacting portion 44, which is formed different from that of the lower contacts 3. The contact portion 44 is extends upward from the upper rear end of the base portion, above the contacting portion 34 of the lower contact 3, then extending straight further rearward, and makes a downward-and-upward curve as "U" at its rearward end portion 44*a*.

These upper contacts 4 are also stamped into and retained in the housing 2 in the same way as the lower contacts 3. Each contacting portion 44 is received in its respective, upper contact-receiving groove 21*c*, so only the lower portion of its end portion 44*a* extrudes into the module-receiving slot 21*a*.

Figure 2:
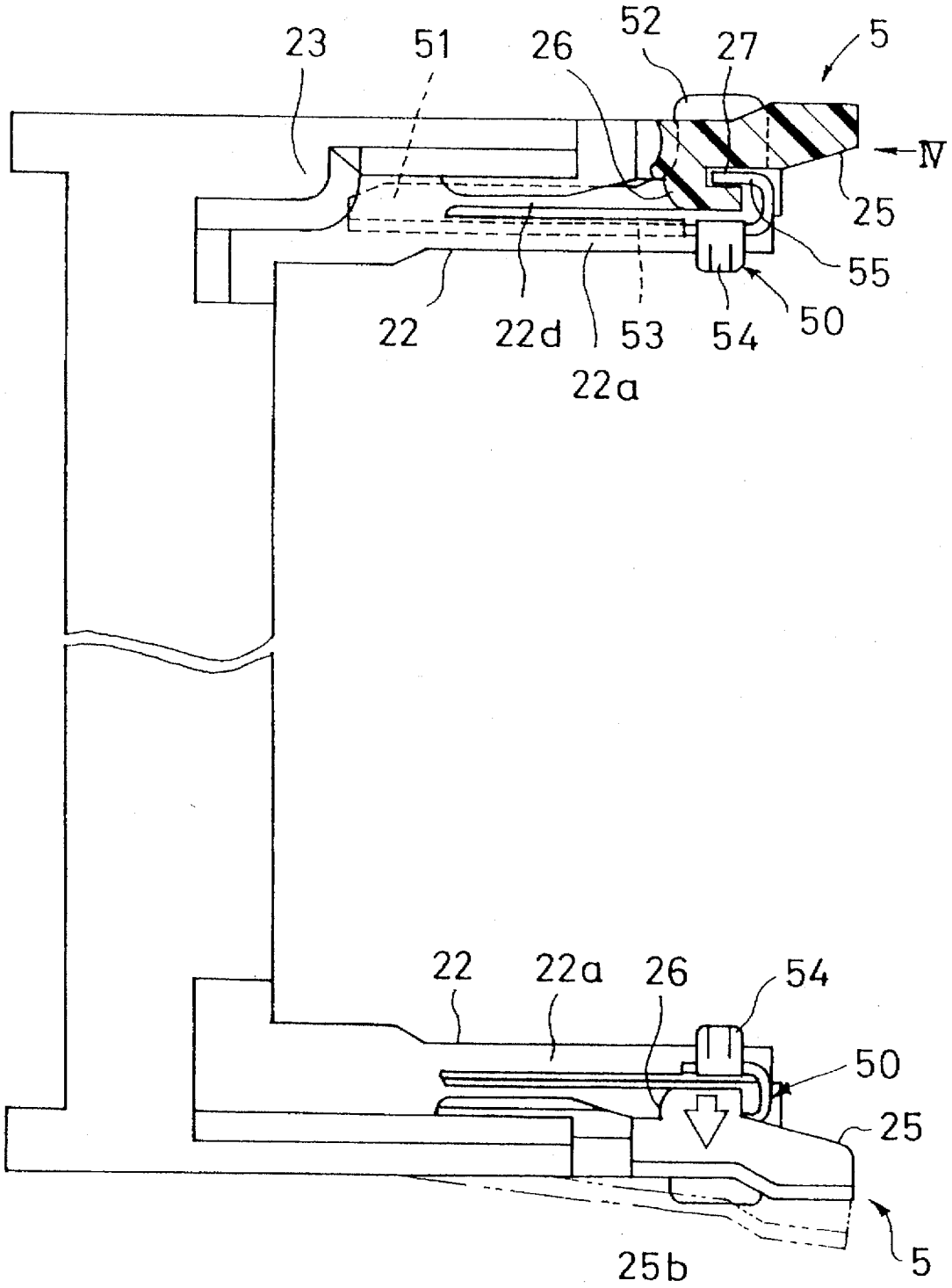
FIG. 2 is a partially cross-sectioned, plan view of the edge connector.
Figure 4A:
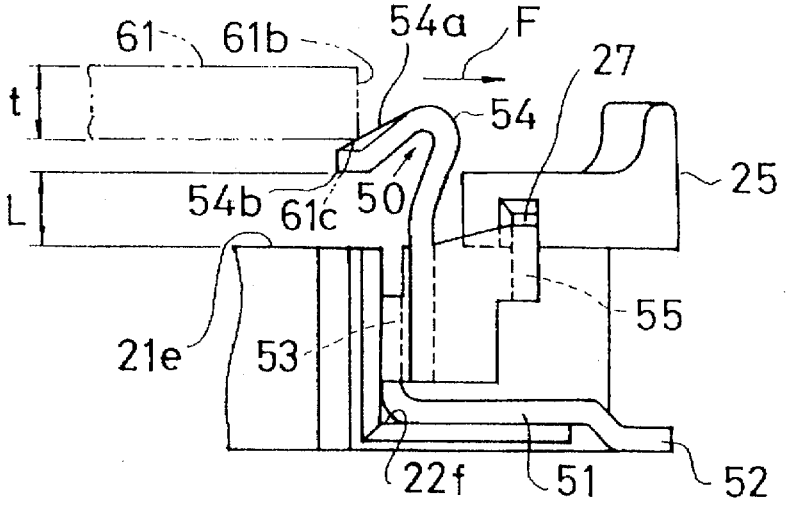
FIG. 4A is a partially enlarged view of the edge connector, seen from IV direction in FIG. 2, with a circuit board being lowered.
Figure 4B:
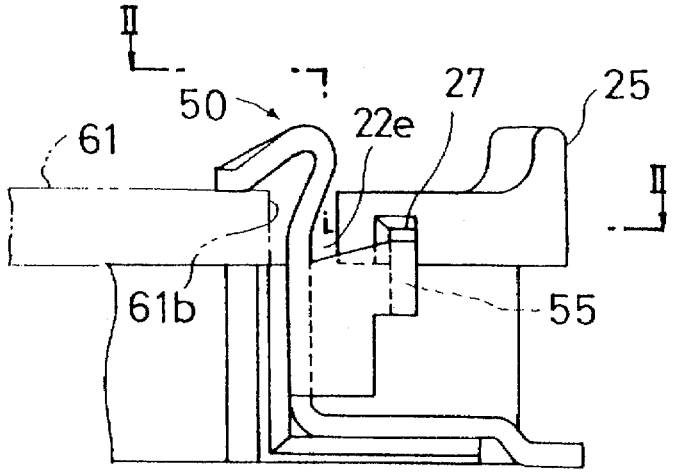
FIG. 4B is a partially enlarged view of the edge connector, seen from IV direction in FIG. 2, with the circuit board engaged.
Figure 4C:
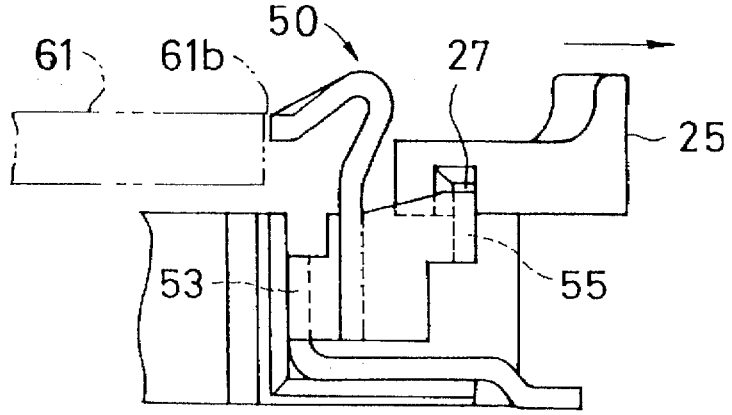
FIG. 4C is a partially enlarged view of the edge connector, seen from IV direction in FIG. 2, with the Circuit board released.

With reference to FIGS. 2 though 6, the locking mechanism 5 is described. For clarification, FIGS. 4A, 4B and 4C show only the parts incorporated in the rear portion of each arm 22, seen from IV direction in FIG. 2.

This locking mechanism 5 comprises a releasing lever 25 and an engaging lock 50. The releasing lever 25 is formed in one piece with each arm 22 of the housing 2, but the engaging lock 50 is formed separate from each arm 22.

Each releasing lever 25 comprises a lever leaf-spring portion 22*d* and a tab for the releasing lever 25. The lever leaf-spring portion 22*d* is formed in a vertical plate extending rearward in the lateral center of each arm 22, and the tab of the releasing lever 25 is formed in one piece with the lever leaf-spring portion 22*d* at the rear end thereof. A positioning boss 26 is provided at the front inside portion of the tab of the releasing lever 25. This positioning boss 26 is capable of fitting into the concavities provided on the sides of a circuit board to be installed in the edge connector. More will be described about this positioning, later.

Because the height of the lever leaf-spring portion 22*d* is formed with a much larger dimension than its width, the lever leaf spring portion 22*d* is capable of swinging laterally about the pivot portion, i.e., the frontal end of the lever leaf-spring portion 22*d*, which is located in the vicinity of the center of each arm 22.

Inwardly adjacent to each lever leaf-spring portion 22*d*, the inside portion 22*a* of each arm 22 is located. Into a gap 22*e* formed between the inside surface of the lever leaf-spring portion 22*d* and the outside surface of the inside portion 22*a*, the engaging lock 50, which will be described later, is inserted. As a result, the lever leaf-spring portions 22*d* are restricted from swinging inward. Since the outside portion 22*b* of each arm 22 is formed shorter than the inside portion 22*a*, the outside portions 22*b* do not interfere with the lever leaf-spring portions 22*d* of the releasing lever 25 swinging outward. Therefore, only the outward swings of the lever leaf-spring portions 22*d* are allowed.

Each engaging lock 50 is press formed of a metal such as brass, copper, iron or alloys of these, and then plated with solder, etc.

Each engaging lock 50 comprises a base portion 51, a surface mount 52, an engaging leaf-spring portion 53, an engaging portion 54, and a hook 55. The base portion 51 extends horizontally, and the surface mount 52 extends from the rear portion (right-side portion in FIG. 2) of the base portion 51 outward beyond the arm 22. The engaging leaf-spring portion 53 extends upward from the front portion of this base portion 51 and then extends rearward. The engaging portion 54 extends from the upper rear portion of this engaging leaf-spring portion 53 and then extrudes inward beyond the inside surface of the arm 22, in an inverted "U" figure. The hook 55 extends from the rear end of the engaging leaf-spring portion 53 and horizontally curves in a "U" figure to return forward.

Furthermore, the lower surface of the surface mount 52 is positioned lower than that of the arm 22.

With this construction, this engaging lock 50 is incorporated into each arm 22. With the inside surface of the engaging leaf-spring portion 53 facing with the outside surface of the inside portion 22*a*, the base portion 51 is stamped into and retained in the base-insertion slot 22*f*, which is provided extending back and forth in the lower portion of the arm 22. At the same time, the hook 55 is inserted into and retained in a slit 27 formed opening rearward, which is provided in the releasing lever 25.

Figure 3A:
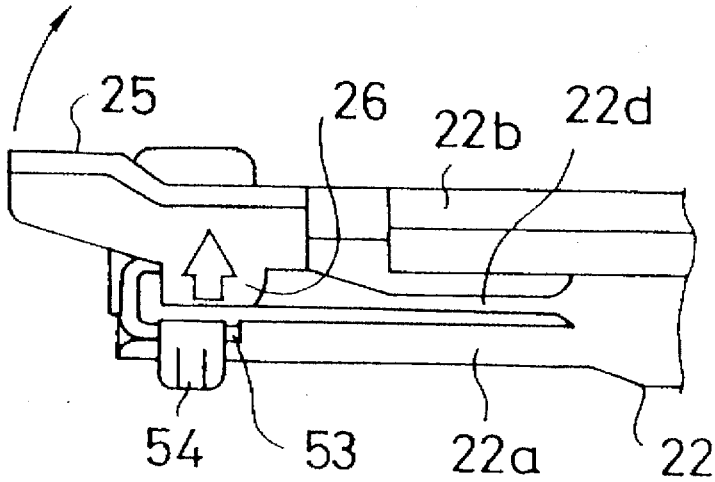
FIG. 3A is a plan view of the releasing lever and engaging lock of the edge connector, in the engaging position.
Figure 3B:
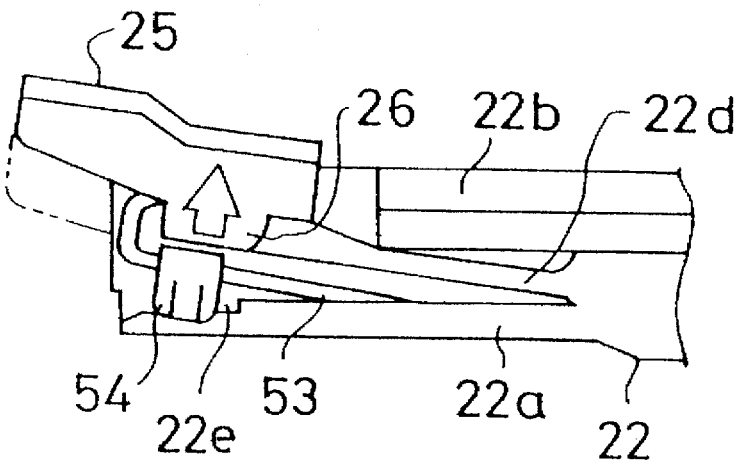
FIG. 3B is a plan view of the releasing lever and engaging look of the edge connector, in the releasing position.

This locking mechanism 5, which is provided in the rear portion of each arm 22 as mentioned above, is capable of swinging laterally between an engaging position and a releasing position. In this engaging position, the inside surfaces of the engaging leaf-spring portions 53 meet the outward surfaces of the inside portions 22*a*, and the front portions of the engaging portions 54 protrude inward beyond the inside surface of the inside portions 22*a*, and both the lever leaf-spring portions 22*d* and the engaging leaf-spring portions 53 are free from any lateral force, as shown in FIG. 3A. In the releasing position, the front portions of the engaging portions 54 are positioned outward beyond the inside surfaces of the inside portions 22*a* as shown in FIG. 3B, so the front portions can pass through the concaved spaces provided on the circuit board. In the releasing position, the engaging portions 54 are biased to the engaging position by both the leaf-spring portions 22*d* and 53.

Figure 8:
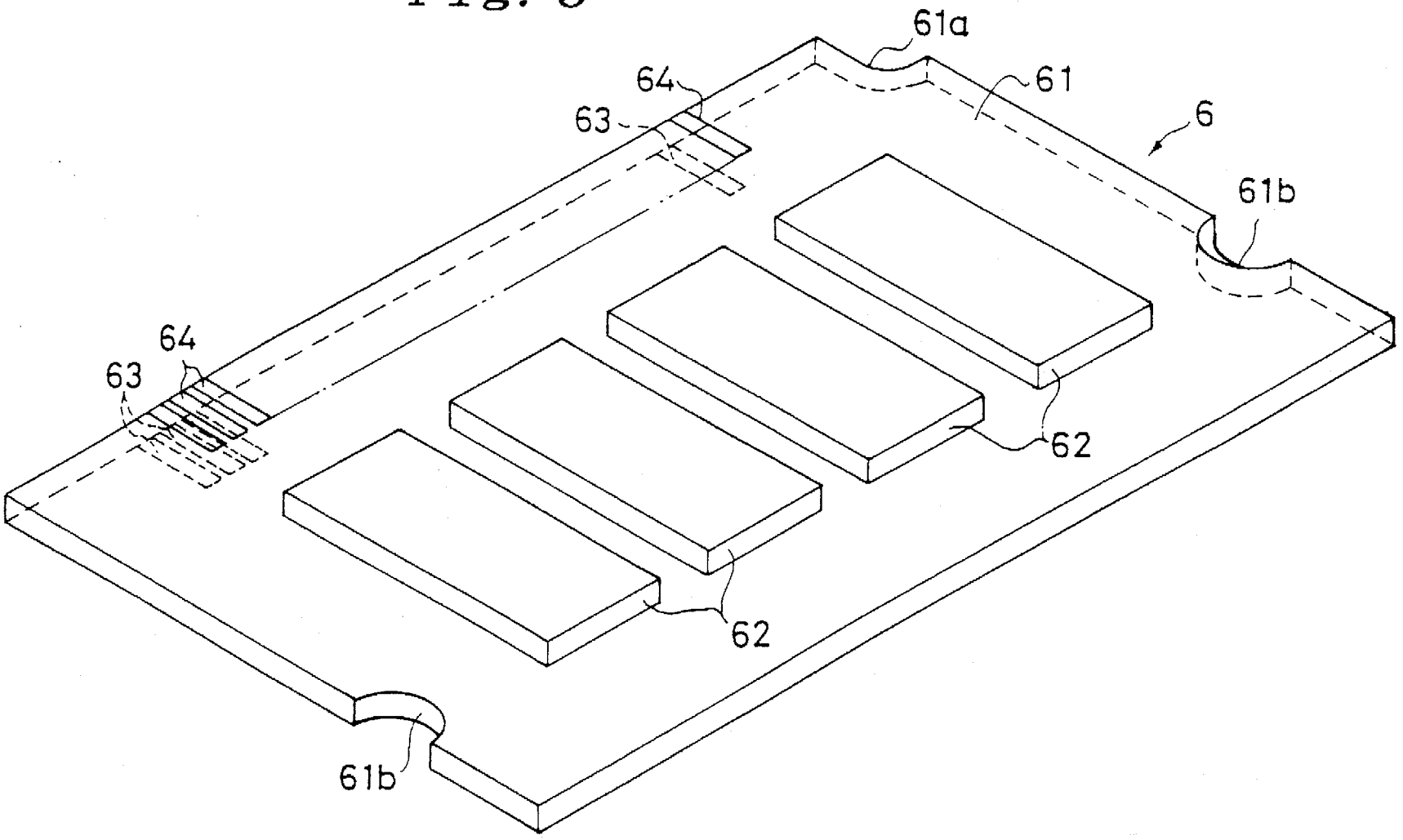
FIG. 8 is a perspective view of a memory module, which is an example of the circuit board.

Into the edge connector 1 constructed as above, a memory module 6 shown in FIG. 8 is removably inserted. This memory module 6 comprises a modularcircuit board 61 resembling a card and a plurality of memory chips 62 mounted thereon. A plurality of electrically conductive pads 63 and 64 are provided on the upper surface and lower surface of the front end portion of the modular circuit board 61. These pads 63 and 64 are connected to the memory chips 62 through electrically conductive pathways (not shown in the figure) patterned on the modular circuit board 61.

Furthermore, at the right, front corner of the modular circuit board 61, a female key 61 a is provided by cutting away the corner in a rounded "L" figure, so that upside-down misplacement of the modular circuit board 61 is prevented by the male key 23, which is provided in the housing 2, when the modular circuit board 61 is mounted into the edge connector 1. Also, on the lateral sides of the rear portion of the modular circuit board 61, positioning concavities 61*b* are provided by cutting away portions of the circuit board 61 in a semicircle, so that the modular circuit board 61 is correctly positioned in the edge connector 1 in the back-and-forth direction.

Figure 7A:
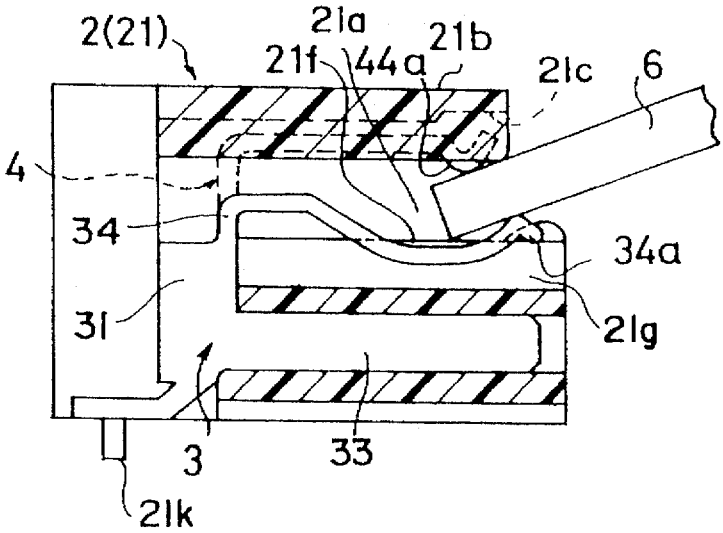
FIGS. 7A is a partially enlarged, sectional view of the edge connector, describing the insertion of the front portion of the circuit board into between two rows of contacts.

Next, the insertion of the memory module 6 into the edge connector 1 and its removal are described. For the insertion of the memory module 6, first, the front portion of the memory module 6 is manually inserted from the upper rear space above the edge connector 1 into the module-receiving slot 21*a* of the main portion 21 of the housing 2, as shown in FIG. 7A. When this insertion is being carried out, the female key 61*a* of the memory module 6 is met with the male key 23 of the edge connector 1, whereby misplacements such as upside-down or rear-side-front insertion of the modular circuit board 61 are avoided. Thus, no mistake is allowed in inserting the memory module 6.

When the front portion of the memory module 6 is inserted into the module-receiving slot 21*a*, the end portions 34*a* of the lower contacts 3 mate with the lower pads 63 of the memory module 6, and the end portions 44*a* of the upper contacts 4 mate with the upper pads 64. As a result, the memory module 6 is retained between the lower contacts 3 and the upper contacts 4 and kept in the jumped-up position, where the rear portion of the modular circuit board 61 is held above the arms 22.

Figure 7B:
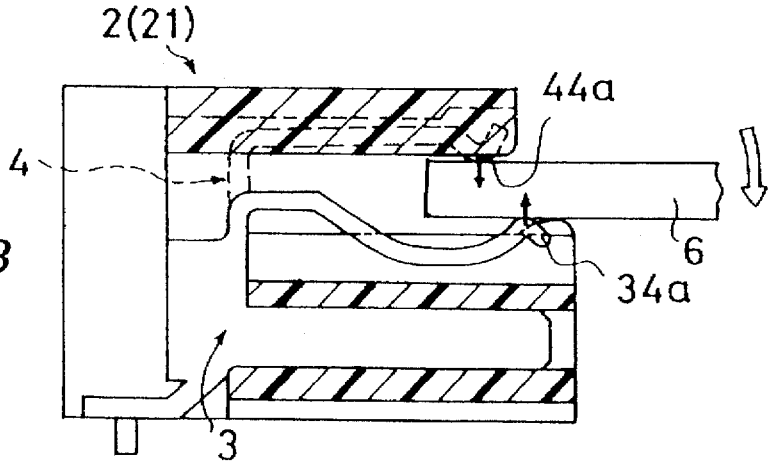
FIGS. 7B is a partially enlarged, sectional view of the edge connector, describing the contacts pressing the front portion of the circuit board.

Then, the rear portion of the memory module 6 is lowered as shown in FIG. 7B, against the resiliency exerted by the elastic, upper contacts 4 and lower contacts 3.

While the memory module 6 is being lowered, the corners 61*c* formed by the lower surface of the memory module 6 and the positioning concavities 61*b* meet the inward upper surfaces 54*a* of the engaging portions 54 standing by at the engaging position. Each corner 61*c* exerts to the engaging portion 54 force F, which works to shift each engaging portion 54 in the direction of the releasing position, as shown in FIG. 4A. As the lowering of the memory module 6 progresses, the corners 61*c* sliding over the upper surfaces 54*a* push the engaging portions 54 into the releasing position. Because the hooks 55 are retained in the slits 27, the releasing levers 25 are transferred outward, always together with the engaging locks 50.

For the purpose of smoothing the sliding of the corners 61*c* over the upper surfaces 54*a*, the upper surfaces 54*a* are gradually slanted from their symmetrical centers. Moreover, the corners 61*c* may be rounded.

When the engaging portions 54 reach the releasing position, the engaging portions 54 enters the positioning concavities 61*b*. After being lowered further, the memory module 6 gets seated on the board-setting surfaces 21*e* of the main body 22 of the housing 2 and on the inside portions 22*a*, which position of the memory module 6 in the edge connector 1 is referred to as the "installation position". When the memory module 6 is set in the installation position, the positioning concaves 61*b* are positioned below the engaging portions 54.

As shown in FIG. 4B, because the distance L between the board-setting surface 21*e* and the lower surface 54*b* of the engaging portion 54 is set almost equal to or greater than the thickness T of the modular circuit board 61, the engaging portions 54 are now returned to the engaging position by the resiliency of both the engaging leaf-spring portion 53 and the lever leaf-spring portion 22*d*. As a result, the lower surfaces 54*b* of the engaging portions 54 come over the upper surface of the modular circuit board 61, and the memory module 6 is retained in the edge connector 1 without its rear portion jumping up.

As shown in FIG. 7B, with the memory module 6 set in the installation position, the lower contacts 3 are lowered a little by the existence of the memory module 6, so their end portions 34*a* are pushed onto their respective, lower pads 63 of the memory module 6 by their resultant resiliency. Likewise, the upper contacts 4 are raised a little, and their end portions 44*a* are pushed onto their respective, upper pads 64 of the memory module 6.

Figure 5:
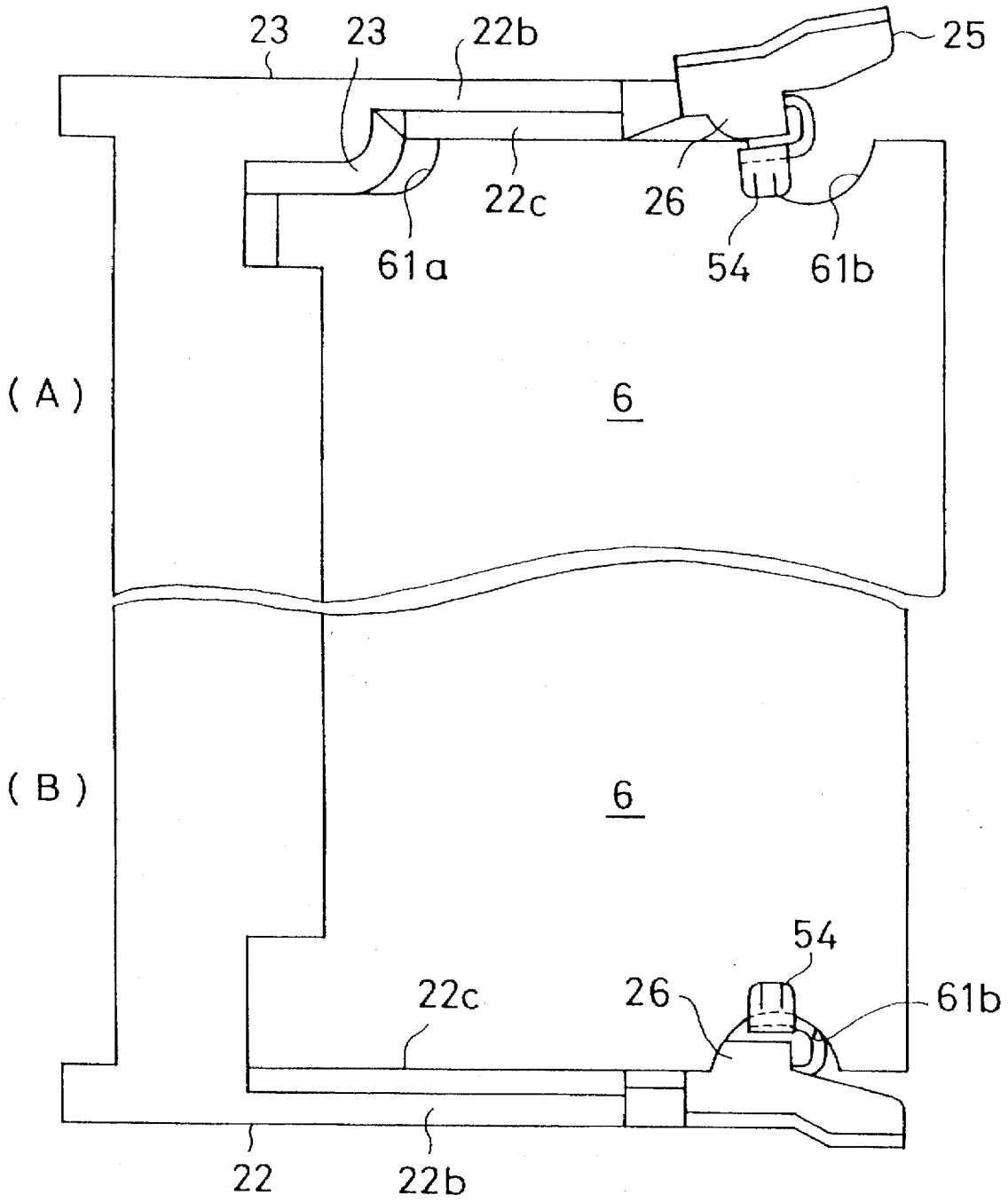
FIG. 5A is a plan view of the edge connector, into which the circuit board is inserted incompletely.
FIG. 5B is a plan view of the edge connector with the circuit board properly engaged.
Figure 6:
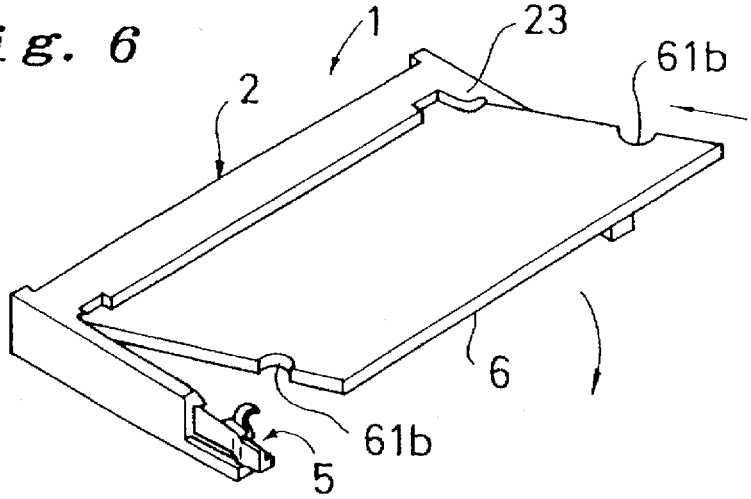
FIG. 6 is a perspective view of the edge connector, describing the installation and removal of the circuit board.

As shown in FIG. 5B, when the memory module 6 is in the installation position, the positioning bosses 26 fit into the positioning concaves 61*b*. The positioning bosses 26 are formed with an arch which fits with the semicircle of the positioning bosses 61*b*.

As shown in FIG. 5A, if the insertion of the memory module 6 into the module-receiving slot 21*a* is not complete, then the positioning bosses 26 do not fit into the positioning concavities 61*b*. Though the memory module 6 is allowed to be lowered with this condition, the modular circuit board 61 of memory module 6 is not retained in the installation position by the engaging portions 54.

With reference to FIG. 4C, the removal of the memory module 6 from the edge connector 1 is described. When the releasing levers 25 are opened laterally with fingers, i.e., they are shifted in the directions indicated by the arrows 25*b* on the upper surfaces of the tabs of the releasing levers 25, the engaging leaf-spring portions 53 swing outward together the releasing levers 25. As a result, the engaging portions 54 are shifted into the releasing position.

When the engaging portions 54 reach the releasing position, the positioning concaves 61*b* pass upward by the tips of the engaging portions 54. As a result, the memory module 6 returns to the jumped-up position. Then the memory module 6 is manually pulled out of the edge connector 1.

With this edge connector 1, the installation of the memory module 6 is carried out easily just by lowering the memory module 6. It has a high durability to stand repeated insertions and removals of the memory module 6 because the engaging portions 54, which contact the modular circuit board 61, are made of a metallic material.

As shown in FIG. 5B, with the memory module 6 installed properly, the engaging portions 54 are accommodated in the positioning concavities 61*b*. As such, the design of this edge connector 1 is compact in the lateral dimension. Moreover, because the positioning bosses 26, which are formed in one piece with the housing 2 through the releasing levers 25, fit into the positioning concavities 61*b*, the memory module 6 in the installation position is retained precisely in position without jumping up or moving rearward, with respect to the edge connector 1. The forward movement of the memory module 6 is also restrained with the female key 61*a* mated with the male key 23 of the edge connector 1.

Furthermore, as shown in FIG. 5A, if the memory module 6 is lowered with incomplete insertion, in which the male key 23 of the edge connector 1 is not mated with the female key 61*a* of the modular circuit board 61, then the memory module 6 is incompletely engaged only by the tips of the engaging portions 54. In this situation, the positioning bosses 26 are not fitted in the positioning concavities 61*b*, so the releasing levers 25 are left extruding outward. In this way, incomplete installation of the memory module 6 in the edge connector 1, if it happens, is obvious to the eyes.

If the memory module 6 happens to be set improperly in the edge connector 1, then the modular circuit board 61 may come out of the engaging portions 54. By observing the releasing levers 25 after mounting the memory module 6 in the edge connector 1, the incomplete installation can be detected and the memory module 6 can be reinstalled, thereby avoiding such accidents. In this way, the proper positioning and retaining of the memory module 6 is attained with this edge connector 1.

Figure 9A:
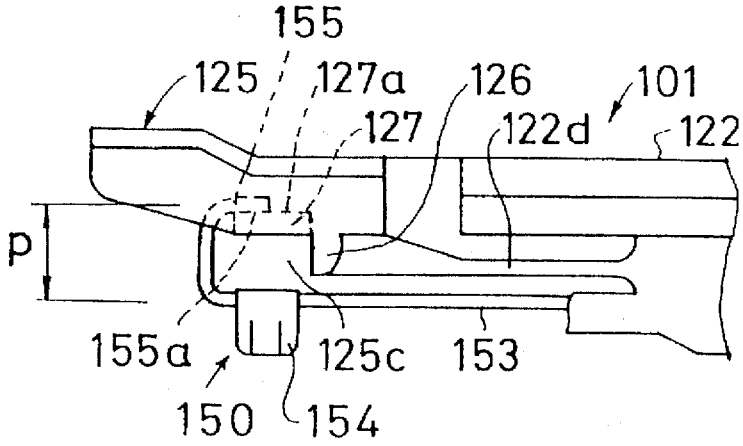
FIGS. 9A, 9B and 9C are partial, plan views of an edge connector as a second embodiment.
Figure 9B:
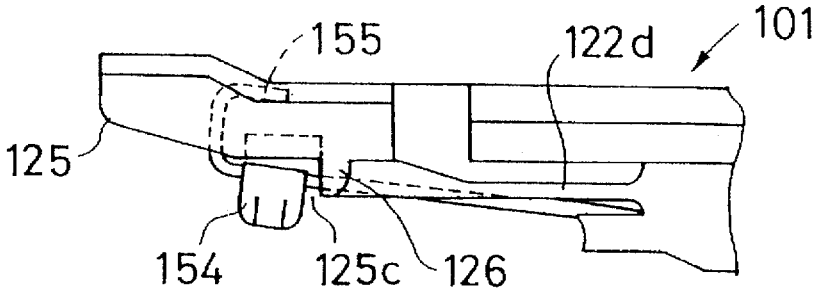
Figure 9C:
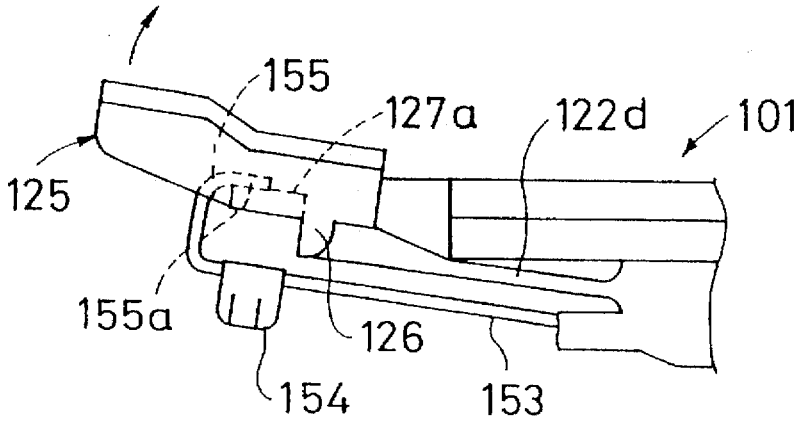
Figure 10A:
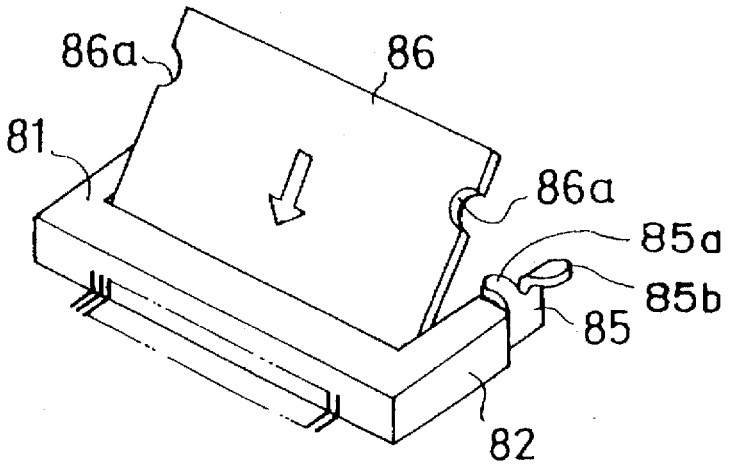
FIGS. 10A, 10B and 10C are perspective views of an edge connector of prior art, describing the installation and removal of the memory module.
Figure 10B:
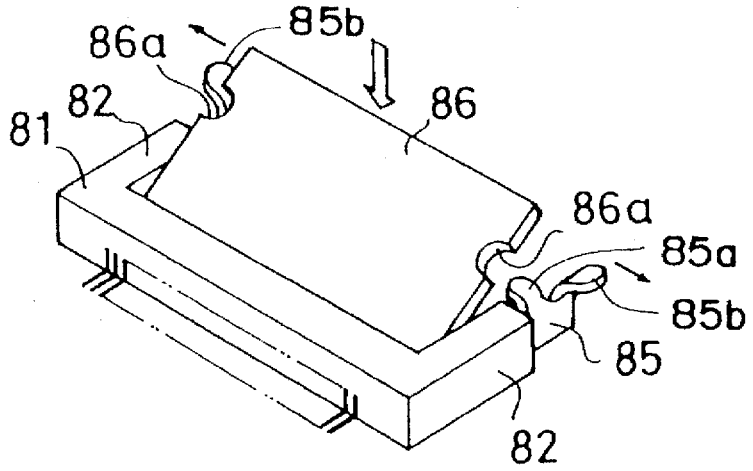
Figure 10C:
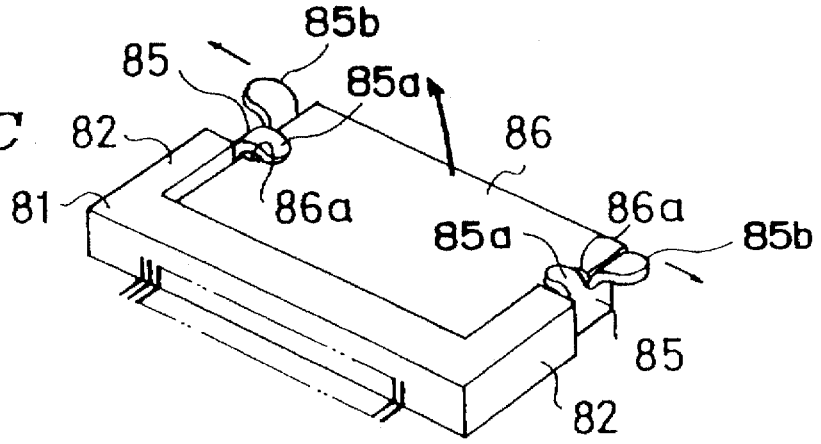

Next, with reference to FIGS. 9A, 9B and 9C, another edge connector 101 is described as a second embodiment of the present invention. This edge connector 101 is constructed in the same way as the edge connector 1 of the previous embodiment, except its lateral arms 122. Therefore, only the lateral arms 122 are described here.

Like the arms 22 of the previous embodiment, each arm 122 of this edge connector 101 includes a releasing lever 125 having a lever leaf-spring portion 122*d* and a tab for the releasing lever 125, which is formed in one piece with this leaf-spring portion 122*d* at the rear end thereof. In this arm 122, an engaging lock 150 similar to the engaging lock 50 of the previous embodiment is incorporated.

This engaging lock 150 includes an engaging leaf-spring portion 153 and a hook 155. The hook 155 extends from the rear end of the engaging leaf-spring portion 153 and horizontally curves in a "U" figure to return forward. The width P of this hook 155, which is the distance between the engaging leaf-spring portion 153 and the lateral outward surface of the hook 155, is wider than that of the previous hook 55.

Furthermore, this releasing lever 125 includes a positioning boss 126 which has the same arc as that of the positioning boss 26 of the previous embodiment. Behind this positioning boss 126 rearward, space 125*c* is reserved for the purpose of accommodating a portion of the engaging lock 150 which swings thereinto. The releasing lever 125 further includes an protrusion 127, which is provided on the lower surface of the tab of the releasing lever 125. With this construction, the protrusion 127 of the releasing lever 125 engages with the hook 155 of the engaging lock 150. However, since the outward part of the extrusion 127 is formed open to the outside of the edge connector 101, the protrusion 127 does not restrain the hook 155 from shifting outward.

As shown in FIG. 9A, the inside surface 155*a* of the hook 155 abuts or approaches the outward surface 127*a* of the protrusion 127 when no force is applied to both the lever leaf-spring portion 122*d* and the engaging leaf-spring portion 153.

As shown in FIG. 9B, when the memory module 6 is lowered for installation in the edge connector 101, only the engaging portions 154 open outward. The releasing levers 127 are not opened along with the engaging portions 154 because the outward swings of the hooks 155 are not restrained in this edge connector 101 unlike the previous edge connector 1. The edge connector 1 of the previous embodiment had releasing levers 25 with slits 27, in which the hooks 55 are engaged, thereby restricting the swings of the hooks 55 with respect to the releasing levers 25 in both inward and outward directions. As a result, the releasing levers 27 swung with the engaging portions 54. When the memory module 6 is further lowered in the edge connector 101, the positioning bosses 126 fit into the positioning concaves 61*b* provided on the sides of the memory module 6, and the memory module 6 is engaged and retained in the edge connector 101 in the same way as when the memory module 6 is lowered in the edge connector 1 of the previous embodiment.

If the memory module 6 is inserted insufficiently and lowered, then a similar situation to the one shown in FIG. 5A will be encountered. The lower surface of the memory module 6 meets the upper surface of the positioning bosses 126 and the memory module 6 is not allowed to be further lowered into the installation position. The reason is that, in this edge connector 101, the positioning bosses 126, which are provided to the releasing levers 125, do not open when the memory module 6 is lowered into the installation position.

For removing memory module 6 out of the installation position of the edge connector 101, the releasing levers 125 are opened laterally outward as shown in FIG. 9C. With these outward swings of the releasing levers 125, the outward surfaces 127*a* of the protrusions 127, which are formed on the lower surfaces of the tabs of the releasing levers 125, meet and push the inward surfaces 155*a* of the hooks 155 outward. As a result, the engaging locks 150 swing outward along with the outward shifts of the releasing levers 125, thereby shifting the engaging portions 154 to the releasing position.

In the above embodiments, semicircular cutout portions 61*b* are provided to the memory module 6 as a means for positioning the memory module 6. The shape applied for these cutout portions for positioning is not limited to semicircle in the edge connectors of the present invention. The cutout portions can be rectangular, and they may be provided as through-holes, instead of as notches on the sides.

Furthermore, in the above embodiments, the vicinities of the cutout portions 61*b* on the upper surface of the memory module 6 are applied as the portions to be engaged for the retention of the memory module 6 in the edge connectors. However, other portions of the memory module may be engaged for retention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An edge connector comprising:

a housing formed of resin, having a main body including a receptive space capable of receiving a front end portion of a circuit board, and a pair of arms extending rearward from both lateral ends of said main body, a plurality of contacts provided in alignment in said receptive space; said contacts being for coming into pressing contact with electrically conductive pads provided on the front end portion of said circuit board when said circuit board is lowered from a jumped-up position to an installation position, the jumped-up position being where the front end portion of said circuit board is positioned in said receptive space and the rear portion of said circuit board is kept above said arms, and the installation position being where the front end portion of said circuit board is kept in said receptive space and the rear portion of said circuit board is placed along said arms; and locking means incorporated in said arms for fixedly retaining said circuit board in the installation position, wherein:

said locking means has an engaging lock and a releasing lever;

said engaging lock is formed of metal, is incorporated in said housing and is capable of being moved between an engaging position and a releasing position: the engaging position being where said engaging lock engages with said circuit board to retain said circuit board in the installation position and the releasing position being where said engaging lock is released from the engagement, said engaging lock further including an engaging leaf-spring portion which enables said engaging lock to swing between the engaging position and the releasing position, and through which said engaging lock is positioned at the engaging position when no outside force is applied to said engaging leaf-spring portion; and said releasing lever and said housing are integrally formed together in one piece from resin and said releasing lever is capable of engaging with said engaging lock, said engaging lock being moved from the engaging position to the releasing position when said releasing lever is manually operated outward.

2. The edge connector as set forth in claim 1 wherein, said contacts are aligned in two rows in said receptive space, each row facing the other vertically, between which rows the front end portion of said circuit board is held when the front end portion of said circuit board is received in said receptive space, whereby said circuit board is held in the jumped-up position; and when said circuit board Is lowered into the installation position, said contacts are elastically deformed by the front end portion of said circuit board, whereby said contacts receiving resiliency from the elastic deformation are in pressing contact with said electrically conductive pads.

3. The edge connector as set forth in claim 1 wherein said engaging lock further includes an engaging portion formed with an inward slant on the upper portion of said engaging lock, so that said engaging portion is met with a side edge of said circuit board being lowered from the jumped up position into the installation position, and said engaging portion engaging with said side edge of the circuit board is pushed thereby shifting said engaging lock into the releasing position; and when said circuit board is completely lowered into the installation position, said engaging portion finishes the engagement with the side edge of the circuit board, whereby said engaging lock returns into the engaging position by the resiliency of said engaging leaf-spring portion.

4. The edge connector as set forth in claim 1 wherein:

said releasing lever further includes a releasing leaf-spring portion, whereby said releasing leaf-spring portion elastically deforms to allow said releasing lever to be swung for the releasing operation.

5. The edge connector as set forth in claim 1 wherein:

said circuit board further includes positioning cavities formed on both sides thereof, and said releasing lever is formed with a positioning boss in one piece, whereby said positioning boss is capable of fitting into said respective positioning cavities of said circuit board positioned in the installation position.

6. The edge connector as set forth in claim 1 wherein:

said engaging lock and said releasing lever are always engaged with each other, whereby said engaging lock shifts along with said releasing lever between the engaging position and the releasing position.

7. An edge connector comprising:

a housing formed of resin, having a main body including a receptive space capable of receiving a front end portion of a circuit board, and a pair of arms extending rearward from both lateral ends of said main body, a plurality of contacts provided in alignment in said receptive space; said contacts being for coming into pressing contact with electrically conductive pads provided on the front end portion of said circuit board when said, circuit board is lowered from a jumped-up position to an installation position, the jumped-up position being where the front end portion of said circuit board is positioned in said receptive space and the rear portion of said circuit board is kept above said arms, and the installation position being where the front end portion of said circuit board is kept in said receptive space and the rear portion of said circuit board is placed along said arms; and locking means incorporated in said arms for fixedly retaining said circuit board in the installation position, wherein:

said locking means has an engaging lock and a releasing lever;

said engaging lock is formed of metal, is incorporated in said housing and is capable of being moved between an engaging position and a releasing position: the engaging position being where said engaging lock engages with said circuit board to retain said circuit board in the installation position and the releasing position being where said engaging lock is released from the engagement, and said releasing lever engages with said engaging lock and moves it from the engaging position into the releasing position when said releasing lever is manually operated outward for the releasing operation; but only said engaging lock is moved from the stationary position into the releasing position while said releasing lever remains stationary, when an outside force to push said engaging lock outward is applied only to said engaging lock while said releasing layer is left free of outside force.

8. The edge connector as set forth in claim 7 wherein said contacts are aligned in two rows in said receptive space, each row facing the other vertically, between which rows the front end portion of said circuit board is held when the front end portion of said circuit board is received in said receptive space, whereby said circuit board is held in the jumped-up position; and when said circuit board is lowered into the installation position, said contacts are elastically deformed by the front end portion of said circuit board, whereby said contacts receiving resiliency from the elastic deformation are in pressing contact with said electrically conductive pads.

9. The edge connector as set forth in claim 7 wherein said engaging lock further includes an engaging portion formed with an inward slant on the upper portion of said engaging lock, so that said engaging portion is met with a side edge of said circuit board being lowered from the jumped up position into the installation position, and said engaging portion engaging with said side edge of the circuit board is pushed thereby shifting said engaging lock into the releasing position; and when said circuit board is completely lowered into the installation position, said engaging portion finishes the engagement with the side edge of the circuit board, whereby said engaging lock returns into the engaging position by the resiliency of said engaging leaf-spring portion.

10. The edge connector as set forth in claim 7 wherein:

said releasing lever further includes a releasing leaf-spring portion, whereby said releasing leaf- spring portion elastically deforms to allow said releasing lever to be swung for the releasing operation.

11. The edge connector as set forth in claim 7 wherein:

said circuit board further includes positioning cavities formed on both sides thereof, and said releasing lever is formed with a positioning boss in one piece, whereby said positioning boss is capable of fitting into said respective positioning cavities of said circuit board positioned in the installation position.

12. The edge connector as set forth in claim 7 wherein:

said engaging lock and said releasing lever are always engaged with each other, whereby said engaging lock shifts along with said releasing lever between the engaging position and the releasing position.

* * * * *